US005707580A

United States Patent [19]

Colley et al.

[11] Patent Number: 5,707,580

[45] Date of Patent: Jan. 13, 1998

[54] FLASH-SPINNING PROCESS

[75] Inventors: Daniel Scott Colley, Alexandria; Ervin Townsend Powers, Jr., Midlothian, both of Va.

[73] Assignee: E. I. du Pont de Nemours and Company, Wilmington, Del.

[21] Appl. No.: 641,405

[22] Filed: May 1, 1996

[51] Int. Cl.[6] ..... D01D 5/11

[52] U.S. Cl. ..... 264/441; 264/205; 264/469

[58] Field of Search ..... 264/13, 205, 211, 264/211.14, 349, 441, 469; 425/3, 200, 382.2

[56] References Cited

U.S. PATENT DOCUMENTS

| | | | |
|---|---|---|---|
| 3,081,519 | 3/1963 | Blades et al. | 57/248 |
| 3,227,794 | 1/1966 | Anderson et al. | 264/205 |
| 3,484,899 | 12/1969 | Smith | 425/171 |
| 3,532,589 | 10/1970 | David | 428/156 |
| 3,860,369 | 1/1975 | Brethauer et al. | 425/3 |
| 4,166,091 | 8/1979 | Beebe | 264/205 |
| 5,032,326 | 7/1991 | Shin | 264/13 |
| 5,039,460 | 8/1991 | Shin | 264/13 |
| 5,043,108 | 8/1991 | Samuels | 264/13 |
| 5,147,586 | 9/1992 | Shin et al. | 264/13 |
| 5,192,468 | 3/1993 | Coates et al. | 264/13 |
| 5,250,237 | 10/1993 | Shin | 264/13 |

*Primary Examiner*—Leo B. Tentoni

[57] ABSTRACT

An improved apparatus and process for flash-spinning plexifilamentary film-fibrils are provided in which a static mixing device is provided in the conduit through which the polymer and spin agent are provided to the spin orifice of the flash spinning apparatus. Preferably, the flash-spinning apparatus includes a chamber immediately upstream of the spinning orifice and the static mixing device is disposed within the chamber. Plexifilamentary webs produced according to the invention have been found to have more densely spaced film-fibrils, more tie points and fewer holes. Bonded plexifilamentary sheets made from such webs have a more uniform thickness and a slightly higher tensile strength than sheets produced without the use of static mixers.

4 Claims, 2 Drawing Sheets

FLASH-SPINNING PROCESS

FIELD OF THE INVENTION

This invention relates to an improved apparatus and process for flash-spinning a plexifilamentary material from a mixture of a polymer and a spin agent. More particularly, the invention is directed to an improved method for mixing polymer and spin agent in a process for flash-spinning a plexifilamentary strand or web.

BACKGROUND OF THE INVENTION

The art of flash-spinning plexifilamentary film-fibrils from a polymer in a solution or a dispersion is known in the art. The term "plexifilamentary" means a three-dimensional integral network of a multitude of thin, ribbon-like, film-fibril elements of random length and with a mean thickness of less than about 20 microns. In plexifilamentary structures, the film-fibril elements are generally coextensively aligned with the longitudinal axis of the structure and they intermittently unite and separate at irregular intervals in various places throughout the length, width and thickness of the structure to form the three-dimensional network.

U.S. Pat. No. 3,081,519 to Blades et al. (assigned to E.I. du Pont de Nemours & Company ("DuPont")) describes a process wherein a polymer in solution is forwarded continuously to a spin orifice at a temperature above the boiling point of the solvent, and at autogenous pressure or greater, and is flash-spun into a zone of lower temperature and substantially lower pressure to generate a strand of plexifilamentary material. U.S. Pat. No. 5,192,468 to Coates et al. (assigned to DuPont) discloses another process for flash-spinning a plexifilamentary strand according to which a mechanically generated dispersion of melt-spinnable polymer, carbon dioxide and water under high pressure is flashed through a spin orifice into a zone of substantially lower temperature and pressure to form a plexifilamentary strand.

U.S. Pat. No. 3,227,794 to Anderson et al. (assigned to DuPont) teaches that plexifilamentary film-fibrils are best obtained when the pressure of the polymer and spin agent is reduced slightly in a preflashing letdown chamber prior to entering the spin orifice. U.S. Pat. No. 3,484,899 to Smith (assigned to DuPont) discloses a known flash-spinning apparatus. This patent describes a horizontally oriented spin orifice through which a plexifilamentary strand can be flash-spun. The polymer strand is conventionally directed against a rotating lobed deflector baffle to spread the strand into a more planar web structure that the baffle alternately directs to the left and right. As the spread web descends from the baffle, the web is passed through an electric corona generated between an ion gun and a target plate. The corona charges the web so as to hold it in a spread open configuration as the web descends to a moving belt. The belt is grounded to help insure proper pinning of the charged web on the belt. The fibrous sheet formed on the belt has plexifilamentary film-fibril networks oriented in an overlapping multi-directional configuration.

The fibrous sheets produced by the above-described flash spinning process may be bonded or they may be used in the form of unbonded batts. The fibrous sheets can be used in wall coverings, air infiltration barriers, envelopes, insulation materials, soft textile-like nonwovens fabrics, and substrates for various coatings and laminates. For many applications, it is important that the plexifilamentary fibrous strand and web be as uniform as possible. A denser and more uniform distribution of the film-fibrils in the web structure produces a sheet product of more uniform thickness and with more uniform properties. With increased sheet uniformity, production of sheet material that does not meet product specifications is reduced significantly. In addition, plexifilamentary sheets can be made thinner with such uniform webs, which uses less polymer, while achieving properties obtainable only with a considerably thicker sheet made from a less uniform web. Accordingly, there is a need to improve the flash-spinning process in a manner that increases the uniformity and density of a spun plexifilamentary film-fibril web and that reduces the size and number of holes in the plexifilamentary web.

SUMMARY OF THE INVENTION

There is provided by this invention an improved flash-spinning apparatus and process. The apparatus and process are generally of the type disclosed in FIG. 1 of Brethauer et al., U.S. Pat. No. 3,860,369. The improvement to the apparatus comprises providing a static mixing device in the conduit through which the polymer and spin agent are provided to the spin orifice of the flash spinning apparatus. Preferably, the flash-spinning apparatus includes a chamber immediately upstream of the spinning orifice and the static mixing device is disposed within this chamber. The improvement to the process of the invention comprises the step of mixing the mixture of polymer and spin agent in the conduit through which the polymer and spin agent are provided to the spin orifice of the flash spinning apparatus with a static mixing device located upstream of the spin orifice.

Plexifilamentary webs produced according to the invention have been found to have more densely spaced film-fibrils, more tie points and fewer holes per unit length. Bonded plexifilamentary sheets made from such webs have a more uniform thickness and a slightly higher tensile strength than sheets produced without the use of static mixers.

BRIEF DESCRIPTION OF THE DRAWINGS

The accompanying drawings, which are incorporated in and constitute a part of this specification, illustrate the presently preferred embodiments of the invention and, together with the description, serve to explain the principles of the invention.

DETAILED DESCRIPTION OF THE PREFERRED EMBODIMENT

Reference will now be made in detail to the presently preferred embodiments of the invention, examples of which are illustrated below.

Figure 1:
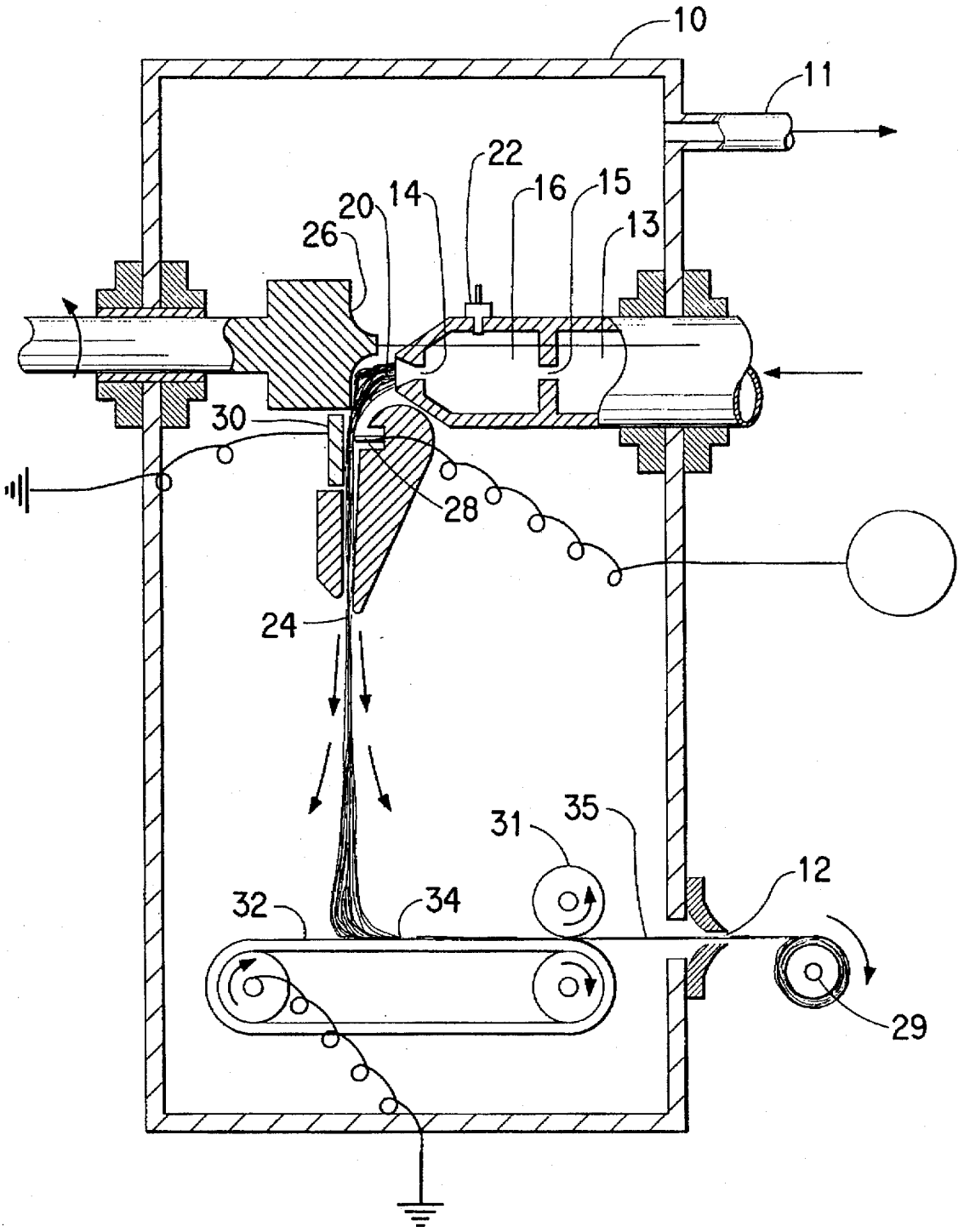
FIG. 1 (PRIOR ART)
FIG. 1 is a cross-sectional schematic representation of a spinning apparatus according to the prior art.

The general flash-spinning apparatus chosen for illustration of the present invention is similar to that disclosed in U.S. Pat. No. 3,860,369 to Brethauer et al., which is hereby incorporated by reference. A system and process for flash-spinning a polyolefin is fully described in U.S. Pat. No. 3,860,369, and is shown in FIG. 1 herein. The flash-spinning process is normally conducted in a chamber 10, sometimes referred to as a spin cell, which has a solvent-removal port 11 and an opening 12 through which non-woven sheet material produced in the process is removed. A mixture of polymer and spin agent is provided through a pressurized supply conduit 13 to a spinning orifice 14. The mixture passes from supply conduit 13 to a chamber 16 through a chamber opening 15. In certain spinning applications, chamber 16 may act as a pressure letdown chamber wherein a pressure reduction precipitates the nucleation of polymer from a polymer solution, as is disclosed in U.S. Pat. No. 3,227,794 to Anderson et al. A pressure sensor 22 may be provided for monitoring the pressure in the chamber 16.

The polymer mixture in chamber 16 next passes through spin orifice 14. It is believed that passage of the pressurized polymer and spin agent from the chamber 16 into the spin orifice generates an extensional flow near the approach of the orifice that helps to orient the polymer into long polymer molecules. As the polymer passes through the spin orifice, the polymer molecules are further stretched and aligned. When polymer and spin agent discharge from the orifice, the spin agent rapidly expands as a gas and leaves behind fibrillated plexifilamentary film-fibrils. The gas exits the chamber 10 through the port 11. The spin agent's expansion during flashing accelerates the polymer so as to further stretch the polymer molecules just as the film-fibrils are being formed and the polymer is being cooled by the adiabatic expansion. The quenching of the polymer freezes the linear orientation of the polymer molecule chains in place, which contributes to the strength of the resulting flash-spun plexifilamentary polymer structure.

The polymer strand 20 discharged from the spin orifice 14 is conventionally directed against a rotating lobed deflector baffle 26. The rotating baffle 26 spreads the strand 20 into a more planar web structure 24 that the baffle alternately directs to the left and right. As the spread web descends from the baffle, the web is passed through an electric corona generated between an ion gun 28 and a target plate 30. The corona charges the web so as to hold it in a spread open configuration as the web 24 descends to a moving belt 32 where the web forms a batt 34. The belt is grounded to help insure proper pinning of the charged web 24 on the belt. The fibrous batt 34 is passed under a roller 31 that compresses the batt into a sheet 35 formed with plexifilamentary film-fibril networks oriented in an overlapping multi-directional configuration. The sheet 35 exits the spin chamber 10 through the outlet 12 before being collected on a sheet collection roll 29.

It has now been found that a denser and more uniform distribution of the film-fibrils in a plexifilamentary strand and in a plexifilamentary web generated from such a strand can be produced by improving the mixing of the polymer and spin agent immediately upstream of the spin orifice. It has also been found that more uniform sheet structures can be produced from the more uniform polymer webs produced by the method of the invention.

According to the method of the invention, improved plexifilamentary material is obtained by mixing the polymer and spin agent directly upstream of the spin orifice 14. This mixing is achieved by inserting a mixing device in the conduit through which polymer and spin agent passes on the way to the spin orifice. If the flash-spinning apparatus is one that has a chamber 16 directly upstream of the spinning orifice, then the mixing device may be inserted in such chamber. Alternatively, the mixing device may be inserted in the supply passage 19. However, placement of the mixing device in a position close to the spinning orifice should impart the greatest uniformity on the spun plexifilamentary strand and web. It has been found to be beneficial to leave a small distance between the end of the mixing device and the spin orifice. Where a plexifilamentary web is spun from a polymer in solution, it has been found that more uniform webs can be spun when the end of the mixer is spaced a distance from the spin orifice that gives the polymer and spin agent a residence time of at least 0.15 seconds in the space between the mixing device and the spin orifice.

Figure 2:
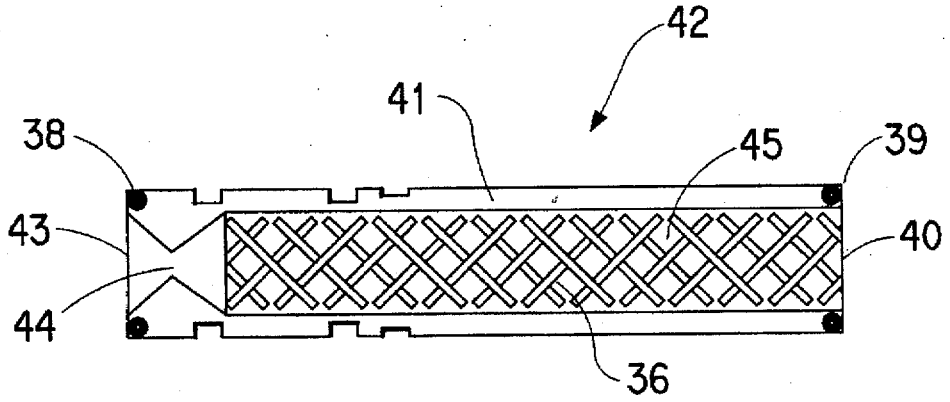
FIG. 2 is a cross-sectional view of a mixing device used in the flash spinning apparatus and method of the present invention.

Preferably the mixing device is a static mixing device like the static mixer 42 shown in FIG. 2. The mixer 42 has a sleeve 41 with an opening 43 and a mixing chamber 45. A series porous and permeable mixing elements disposed within the mixing chamber 45 comprise a mixing insert 36. The mixing insert 36 is preferably comprised of one or more mixing elements made of a corrosion resistant material such as high strength stainless steel and may be coated with a friction reducing coating such as a TEFLON® non-stick finish. TEFLON® is a registered trademark of DuPont. The opening 43 may taper to a mixer orifice 44 through which polymer and spin agent enter the mixing chamber. O-rings 38 and 39 seal the mixer sleeve 41 within the chamber or conduit of the flash-spinning apparatus.

Sleeve 41 preferably is made of a hard metal such as Inconel alloy, has an outside diameter of 3.18 cm (1.25 in), an inside diameter of 2.04 cm (0.803 in), and a length of 14.54 cm (5.725 in). The diameter of the mixer orifice 44 is preferably about 0.180 cm (0.071 in). The mixer insert is preferably made from either three or four 2.0 cm (0.80 in) O.D. by 2.0 cm (0.80 in) long Model SMX mixing elements that have been welded together, as sold by Koch Engineering Company, Inc. of Wichita, Kans.

Figure 3:
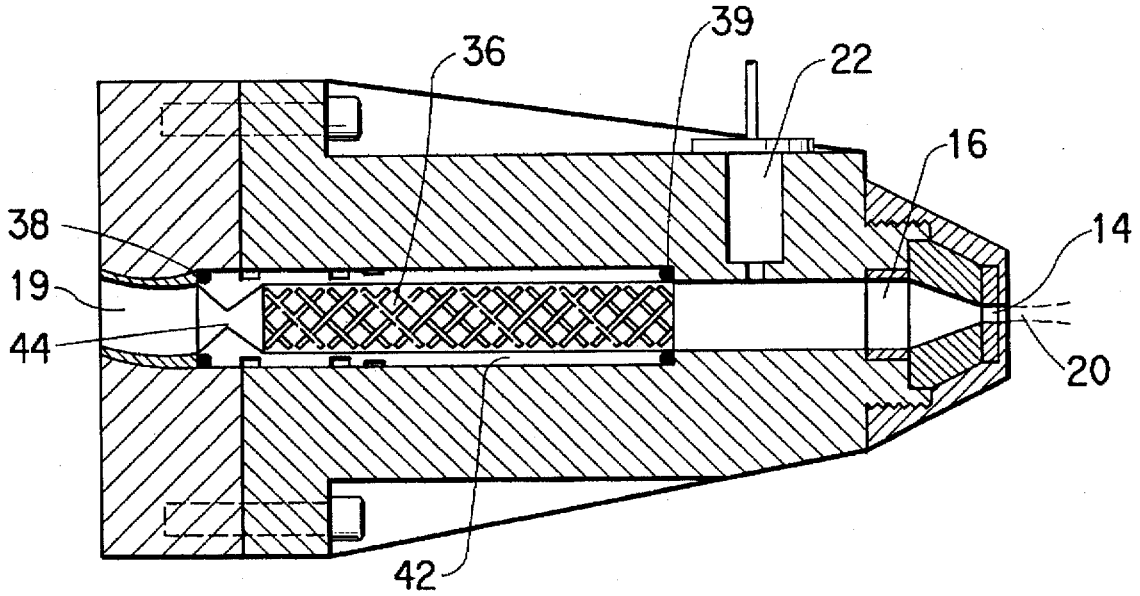
FIG. 3 is a cross-sectional view of a portion of a spinning apparatus for flash spinning plexifilamentary material according to the method of the present invention.

As shown in FIG. 3, the mixer 42 can be inserted in the chamber 16 of a spinneret assembly such that chamber 16 and mixing chamber 45 of the mixer 42 together form a single chamber. When plexifilamentary material is flash spun from a polymer solution, this chamber is used like the letdown chamber described in U.S. Pat. No. 3,227,794 to Anderson et al. In such applications, the pressure of the polymer solution upstream of the mixer orifice 44 is maintained such that the pressure drop across the mixer orifice begins the nucleation of polymer from the solution. It is believed that the presence of the mixing insert 36 in the chamber improves the mixing of the nucleating polymer and the spin agent with consequent improvement in the uniformity of the plexifilamentary material spun from the mixture. Likewise, it is believed that when plexifilamentary material is spun from a mechanically generated dispersion of polymer and spin agent, passing the mixture of polymer and spin agent through the mixing insert 36 shortly before the mixture enters the spinning orifice makes the mixture more uniform and is responsible for the observed improvement in the uniformity and tenacity of the plexifilamentary material spun from the mixture.

One advantage of using static mixing devices like those described above to improve mixing is that such mixing devices require little maintenance. Unlike mixing screens, the static mixing devices described above are much less readily clogged by the presence of contaminates in the polymer being spun. This advantage is especially important where recycled polymer is being spun. Performance of the static mixing device described above is also improved by the absence of the moving parts found in dynamic mixing devices.

Plexifilamentary webs produced with a static mixer in accordance with the invention have been found to have more densely spaced film-fibrils, more tie points and fewer holes.

Bonded plexifilamentary sheets made from webs produced with a static mixer in accordance with the invention have been found to have a more uniform thickness and a slightly higher tensile strength than sheets produced without the use of static mixers. The following non-limiting examples are intended to illustrate the invention and not to limit the invention in any manner.

EXAMPLES

In the description above and in the non-limiting examples that follow, the following test methods were employed to determine various reported characteristics and properties. ASTM refers to the American Society of Testing Materials, and TAPPI refers to the Technical Association of the Pulp and Paper Industry.

Basis weight was determined by ASTM D-3776, which is hereby incorporated by reference, and is reported in $g/m^2$. The basis weights reported for the examples below are each based on an average of at least twelve measurements made on the sheet.

Tensile Strength was determined by ASTM D1682, Section 19, which is hereby incorporated by reference, with the following modifications. In the test a 2.54 cm by 20.32 cm (1 inch by 8 inch) sample was clamped at opposite ends of the sample. The clamps were attached 12.7 cm (5 in) from each other on the sample. The sample was pulled steadily at a speed of 5.08 cm/min (2 in/min) until the sample broke. The force at break was recorded Newtons/cm as the breaking tensile strength. The tensile strength and elongation values reported for the examples below are each an average of at least twelve measurements made on the sheet for each sample.

Sheet thickness and uniformity were determined by ASTM method D 1777-64, which is hereby incorporated by reference. The thickness values reported for the examples below are each based on an average of at least 100 measurements taken on the sheet for each sample. The uniformity value represents the statistical standard deviation of the measured thickness values. A lower standard deviation is indicative of a more uniformly thick sheet.

Fiber quality is evaluated using a subjective scale of 0 to 3, with a 3 being the highest quality rating. Under the evaluation procedure, a 10 inch length of a plexifilamentary material is removed from a fiber web. The web is spread and mounted on a dark substrate. The fiber quality rating is an average of three subjective ratings, one for fineness of the fiber (finer fibers receive higher ratings), one for the continuity of the fiber strand (continuous plexifilamentary strands receive a higher rating), and the other for the frequency of the ties (more networked plexifilamentary strands receive a higher rating).

COMPARATIVE EXAMPLE 1

Polyethylene was flash spun from a hot trichlorofluoromethane solution as generally described in the Example of Brethauer et al., U.S. Pat. No. 3,860,369. The polyethylene was ALATHON® 7026T , a high density polyethylene that was obtained from Occidental Chemical Corporation of Houston, Tex. and its successor in interest Lyondell Petrochemical Company of Houston, Tex. ALATHON® is currently a registered trademark of Lyondell Petrochemical Company. ALATHON® 7026T has a melt flow rate of 0.76 g/10min by standard techniques at a temperature of 190° C. with a 2.16 Kg weight, and has a melting point of 126°–135° C.

The solution was continuously pumped at a pressure of about 2000 psi to a line of 32 spinneret assemblies like the assembly shown in FIG. 1. In each assembly, the solution was fed into a letdown chamber where the pressure of the polymer and spin agent reduced to about 900 psi. The polyethylene polymer and trichlorofluoromethane spin agent was then immediately extruded into a region at approximately atmospheric pressure. The resulting plexifilamentary strand from each assembly was directed against a corresponding rotating baffle that spread and oscillated the web downward as described above. The web from each spinneret assembly was passed through an electric corona before being deposited on a moving belt. The web from each spinneret assembly formed a strip on the belt, and the strips overlapped the adjoining strips to form a wide batt. The batt was consolidated between rollers at a pressure of about 25 lbs/linear inch before being collected as a lightly consolidated sheet on a collection roll.

The lightly consolidated sheet was subsequently thermal bonded as described in U.S. Pat. No. 3,532,589 to David (assigned to DuPont). During the bonding process, one side of the sheet was heated against a rotating drum to a temperature in the range of about 135° to 140° C. and was subsequently cooled on a cooling roll. The other side of the sheet was subsequently bonded in the same manner.

Spunbonded sheet was manufactured by this described process for 31 days. A sample of the bonded sheet was tested for strength and thickness three times each day and the results were recorded. The results of each of the tests were averaged and are reported in Table A below.

EXAMPLE 1

Spunbonded sheet was manufactured according to the process of Comparative Example 1, except that an in-line static mixer (Koch Engineering) as described above was inserted in the letdown chamber of each mixing assembly as shown in FIG. 3. Spunbonded sheet was manufactured by this described process on approximately 25 days over a 3 month period. One to two samples of the sheet were tested for tensile strength and thickness during each day of production and the results were recorded. The results of all of the tests were averaged and are reported in Table A below.

EXAMPLE 2

Spunbonded sheet was manufactured according to the process of Comparative Example 1, except that an in-line static mixer (Koch Engineering) as described above was inserted in the letdown chamber of each of the 16 spinneret assemblies (as shown in FIG. 3) above the west side of the moving belt. Such mixers were not used in the 16 mixing assemblies above the east side of the belt. Spunbonded sheet was manufactured by this described process for about 24 hours. A sample of the sheet was taken from each side of the sheet approximately every 90 minutes (14 samples total) and was tested. The results of all of the tests were averaged and are reported in Table A below.

TABLE A

| Example No. | Mean Basis Wt. ($g/m^2$) | Mean Thickness (um) | σ Thickness | Tensile (MD) (N/cm) | Tensile (CD) (N/cm) |
|---|---|---|---|---|---|
| Comp. Ex. 1 | 54.2 | 165.9 | 23.52 | 43.74 | 49.45 |
| Ex. 1 (All Mixers) | 53.6 | 161.4 | 22.07 | 46.93 | 53.07 |
| Ex. 2 (Mixers ½) | 74.6 | 200.7 | 23.88 | 72.28 | 81.14 |
| Ex. 2 (No Mixers ½) | 74.6 | 201.9 | 25.65 | 71.22 | 79.84 |

COMPARATIVE EXAMPLE 2

A plexifilamentary polymer web was spun from a mechanically generated dispersion of polymer and supercritical $CO_2$. The spin mixture was generated in a high pressure, high shear, continuous mixer. The mixer was a rotary mixer that operated at temperatures up to 300° C. and at pressures up to 41,000 kPa. The mixer had a polymer inlet through which a blend of melted polymers was continuously introduced into the mixer. The mixer also had a $CO_2$ inlet through which supercritical $CO_2$ was continuously introduced into the polymer stream entering the mixer. The mixer included a mixing chamber where polymer and $CO_2$ were thoroughly sheared and mixed by a combination of rotating and fixed cutting blades. The mixer further included an injection port through which water was introduced into the mixing chamber at a point downstream of where the polymer and $CO_2$ were initially mixed in the mixing chamber. The mixer also had an outlet through which a dispersion of polymer, $CO_2$ and water was continuously discharged from the mixer's mixing chamber. The volume of the mixer's mixing chamber between the point where the polymer first contacts the $CO_2$ and the mixer outlet was 495 $cm^3$. The mixer used in the following examples is more fully described in U.S. patent application Ser. No. 60/005,875, filed Oct. 26, 1995, which is hereby incorporated by reference.

Polymer was injected into the mixer by a polymer screw extruder and gear pump. Supercritical $CO_2$ plasticizing agent from a pressurized storage tank and distilled water from a closed storage tank were both injected into the mixer by double acting piston pumps. The mixer's cutting blades were operated at a rotational rate of approximately 1200 rpm with power of between 7 and 10 kW. The residence time of the polymer in the mixer's mixing chamber was generally between 7 and 20 seconds. A heated transfer line carried the dispersion of polymer, supercritical $CO_2$ and water to a 0.889 mm (35 mils) diameter round spin orifice from which the mixture was flash-spun into a zone maintained at atmospheric pressure and room temperature. The spinning temperature was approximately 240° C. and the spinning pressure was approximately 28,900 kPa. The spin products were collected on a moving belt from which samples were removed for examination and testing.

Ingredients

The polymers from which plexifilamentary webs were spun in this example were comprised of one or more of the following polymer ingredients. The percentages stated in the examples are by weight unless otherwise indicated. Each ingredient has been assigned a code by which it is referred to in the combination descriptions below.

One 4GT polyester used in the following examples was CRASTIN® 6131 obtained from DuPont of Wilmington, Del. CRASTIN® 6131 was formerly sold under the name RYNITE® 6131. CRASTIN® and RYNITE® are registered trademarks of DuPont. CRASTIN® 6131 is a non-reinforced low molecular weight 4GT polyester. CRASTIN® 6131 has a melt flow rate of 42 g/10 min by standard techniques at a temperature of 250° C. with a 2.16 kg weight, and has a melting point of 225° C. ("4GT-6131")

Another 4GT polyester used in the following examples was CRASTIN® 6130 obtained from DuPont of Wilmington, Del. CRASTIN® 6130 is a non-reinforced 4GT polyester with a higher molecular weight than CRASTIN® 6131. CRASTIN® 6130 has a melt flow rate of 12.5 g/10 min by standard techniques at a temperature of 250° C. with a 2.16 kg weight, and has a melting point of 225° C. ("4GT-6130")

The polypropylene used in the following examples was Valtec HH444 obtained from Himont Corporation of Wilmington, Del. Valtec HH444 has a melt flow rate of 70 g/10 min by standard techniques at a temperature of 190° C. with a2.16 kg weight, and has a melting point of 170° C. ("PP")

The polyester elastomer used in the following examples was HYTREL® 3078, a melt spinnable block copolymer obtained from E.I. du Pont de Nemours and Co. of Wilmington, Del. HYTREL® is a registered trademark of DuPont. HYTREL® has a melt flow rate of 5.0 g/10 min by standard techniques at a temperature of 190° C. with a 2.16 kg weight, and it has a melting point in the range of 170°–190° C. ("PEL")

The polyethylene used in the following examples was ALATHON® H6018, a high density polyethylene that was obtained from Occidental Chemical Corporation of Houston, Tex. and its successor in interest Lyondell Petrochemical Company of Houston, Tex. ALATHON® is currently a registered trademark of Lyondell Petrochemical Company. ALATHON® H6018 has a melt flow rate of 18 g/10 min by standard techniques at a temperature of 190° C. with a 2.16 Kg weight, and has a melting point of 130°–135° C. ("PE")

The 2GT polyester used in the following examples was NUPET® (densified pellet). NUPET® is a 100% recycled polyethylene terephthalate obtained from DuPont of Wilmington, Del. NUPET® is a registered trademark of DuPont. NUPET® has a viscosity of 230 pascal seconds at 280° C., and it has a melting point of 252° C. ("2GT")

The partially neutralized ethylene vinyl alcohol copolymer used in the following examples was SELAR® OH BX240 obtained from E.I. du Pont de Nemours and Co. of Wilmington, Del. SELAR® is a registered trademark of DuPont. SELAR® OH BX240 is a melt-blended, pelletized polymer consisting of 90% SELAR® OH 4416 and 10% FUSABOND™ E MB-259D, both polymers being obtained from DuPont of Wilmington, Del. SELAR® OH 4416 is an ethylene vinyl alcohol copolymer having 44 mole % ethylene units, a melt flow rate of 16.0 g/10 min by standard techniques at a temperature of 210° C. with a 2.16 kg weight, and a melting point of 168° C. FUSABOND™ E MB-259D is a polyethylene grafted with 0.2–0.3% maleic anhydride, having a melt flow rate of 20–25 g/10 min by standard techniques at a temperature of 190° C. with a 2.16 kg weight, and a melting point of 120°–122° C. FUSABOND™ is a trademark of DuPont. ("EVOH").

The following four combinations of the above polymer ingredients were injected into a continuous mixer and were mixed with $CO_2$ and water as described above:

Combination A: 100% 4GT-6131

Combination B: 50% 4GT-6131; 35% 4GT-6130; 5% PEL; 10% PP

Combination C: 18% 4GT-6131; 45% 4GT-6130; 16% PE; 12% PEL;

8% PP; 1% EVOH

Combination D: 20% 4GT-6131; 15% 4GT-6130; 50% 2GT; 5% PEL;

10% PP

In each instance, the polymer/$CO_2$ ratio in the mixer was 1.25 and the polymer/water ratio in the mixer was 2.86. The mixture was subsequently flash-spun from a 0.889 mm spinning orifice for approximately 15 minutes. Plexifilamentary fiber webs were obtained that had the tenacity and fiber quality ratings listed in Table B, below.

EXAMPLE 3

The four combinations of the above polymer ingredients described in Comparative Example 2 were spun according to the process of Comparative Example 2, except that a four element in-line static mixer was inserted in a chamber in the spinning assembly approximately 3.2 cm (1.25 in) upstream of the spin orifice. The static mixer had a cylindrical sleeve that held four Model SMX static mixing elements that had been welded together to form a mixing insert, as sold by Koch Engineering Company, Inc. of Wichita, Kans. Each mixing element had a diameter of 1.245 cm (0.49 in) and a length of 1.88 cm (0.74 in). The sleeve had an inside diameter of about 1.27 cm (.5 in) and a length of about 8.89 cm (3.5 in). The internal diameter of the sleeve was slightly larger that the diameter of the supply line through which the mixture of polymer and spin agent were provided to the spinning assembly. The openings at the ends of the sleeve had diameters that were similar to the diameter of the sleeve. An expansion chamber between the outlet of the sleeve and the spin orifice had a length of 3.2 cm (1.25 in) and a cylindrical first section with a diameter of 1.78 cm (0.7 in) adjoining the mixer, and a conical second section that tapered to the size of the spin orifice. Plexifilamentary fiber webs were obtained that had the tenacity and fiber quality ratings listed in Table B, below.

TABLE B

| Example | Polymer Blend | Number of Mixing Elements | Tenacity (gpd) | Fiber Quality |
|---|---|---|---|---|
| Comparative Ex. 1(a) | A | 0 | 0.75 | 1.5 |
| Ex. 3(a) | A | 4 | 1.00 | 1.3 |
| Comparative Ex. 1(b) | B | 0 | 2.35 | 2.5 |
| Ex. 3(b) | B | 4 | 2.55 | 2.5 |
| Comparative Ex. 1(c) | C | 0 | 2.70 | 2.5 |
| Ex. 3(c) | C | 4 | 3.15 | 2.7 |
| Comparative Ex. 1(d) | D | 0 | 1.10 | 2.0 |
| Ex. 3(d) | D | 4 | 1.30 | 1.8 |

It will be apparent to those skilled in the art that modifications and variations can be made the flash-spinning apparatus and process of this invention. The invention in its broader aspects is, therefore, not limited to the specific details or the illustrative examples described above. Thus, it is intended that all matter contained in the foregoing description, drawings and examples shall be interpreted as illustrative and not in a limiting sense.

What is claimed is:

1. In a continuous process for flash-spinning a web of fibrillated plexifilamentary material including the steps of:

continuously supplying under pressure into a dissolution zone molten polyolefin polymer and a solvent for the polymer, the concentration of polymer being 8 to 20% by weight of the solution, dissolving the polyolefin polymer in the solvent and forming a polymer solution having a temperature of at least about 175° and a pressure above the two-liquid-phase pressure boundary for the solution, forwarding the solution through a transfer zone while maintaining the pressure of the solution above the two-liquid-phase pressure boundary for the solution, passing the solution into a pressure letdown chamber for lowering the pressure of the solution to below the two-liquid-phase pressure boundary for the solution to cause nucleation of polymer from the-solution, discharging the solution from the letdown chamber through a spinneret orifice of restricted size to an area of substantially atmospheric pressure and temperature, and forming a web of fibrillated plexifilamentary material;

the improvement comprising the step of mixing the solution and the nucleating polymer within the letdown chamber by passing the solution and polymer through a static mixing device disposed within the letdown chamber.

2. The process of claim 1, wherein the static mixing device is spaced from the spinneret orifice to form a space within the letdown chamber, and wherein the continuous flow of the solution into the letdown chamber is maintained at a rate such that polymer nucleating from the solution and the solvent of the solution have a residence time of at least about 0.15 seconds in the space between the static mixing device and the spinneret orifice.

3. The process of claim 1, wherein the polyolefin polymer is polyethylene.

4. The process of claim 3, wherein the polymer solution is maintained at a pressure greater than 1200 psi prior to entering the letdown chamber, and is maintained at a pressure less than 1000 psi within the letdown chamber.

* * * * *